US007994987B2

(12) United States Patent
Berezin et al.

(10) Patent No.: US 7,994,987 B2
(45) Date of Patent: Aug. 9, 2011

(54) NOTCHED ANTENNA STRUCTURE WITH A STEPPED SHAPED ELEMENT

(75) Inventors: Maksim Berezin, Natanya (IL); Moshe Ben Ayun, Shoham (IL); Ovadia Grossman, Tel Aviv (IL); Mark Rozental, Gedera (IL)

(73) Assignee: Motorola Solutions, Inc., Schaumburg, IL (US)

( * ) Notice: Subject to any disclaimer, the term of this patent is extended or adjusted under 35 U.S.C. 154(b) by 605 days.

(21) Appl. No.: 12/124,378

(22) Filed: May 21, 2008

(65) Prior Publication Data

US 2009/0289854 A1 Nov. 26, 2009

(51) Int. Cl.
*H01Q 1/24* (2006.01)

(52) U.S. Cl. ..... 343/702; 343/767; 343/829

(58) Field of Classification Search ..... 343/767, 343/702, 829, 830
See application file for complete search history.

(56) References Cited

U.S. PATENT DOCUMENTS 5,276,454 A * 1/1994 Gonzalez et al. ..... 343/702
5,572,190 A * 11/1996 Ross et al. ..... 340/541
7,116,937 B2 * 10/2006 Kinzler ..... 455/41.2
2002/0021250 A1 2/2002 Asamo et al.
2007/0103367 A1 5/2007 Wang

OTHER PUBLICATIONS

International Application No. PCT/US2009/044782 with Search Report and Written Opinion, mailed May 21, 2009—11 pages.
International Preliminary Report on Patentability—PCT/US2009/044782, Issued Nov. 23, 2010—5 pages.

* cited by examiner

*Primary Examiner* — Douglas W Owens
*Assistant Examiner* — Dieu Hien T Duong

(57) ABSTRACT

An antenna assembly (10) includes a ground plane formed on a chassis (12) of the radio and the functional knob forming an antenna element (11). The antenna assembly further includes a slot or notch element (14) in the ground plane substantially adjacent to the functional knob and having a length less than ¼ wavelength, and a coaxial cable (13) feeding the antenna element. A shield of the coaxial cable can be directly connected to the ground plane and a center conductor of the coaxial cable can be directly coupled to the functional knob to provide a galvanic connection for narrowband performance or the center conductor can be electromagnetically coupled to the functional knob for wideband performance or both. The antenna assembly can create a zero volume notch type ground excitation.

19 Claims, 6 Drawing Sheets

40

50

60

NOTCHED ANTENNA STRUCTURE WITH A STEPPED SHAPED ELEMENT

FIELD OF THE INVENTION

This invention relates generally to communication devices, and more particularly to a method and system of forming an antenna using a stepped structure in a ground plane that can use existing radio feature architectures.

BACKGROUND

Existing antennas in radios or cellular phones having a wide range of requirements in terms of gain and bandwidth usually come in the form of an integrated stand alone structure inside the equipment or as standard patch antennas on a printed circuit board of the radio. Integration into a standard antenna such as a helical, monopole or patch antenna is not always possible or feasible, particularly for lower frequencies. Standard patch antennas are not big enough to perform properly to meet all the requirements in terms of bandwidth and gain. Further exacerbating the issues facing standard antennas are the trend for making radios smaller. The existing minimal volume antennas are usually components with high Q feeders or resonators that are deficient in terms of gain and bandwidth for current radio requirements. Some of the issues result from random ground excitation.

SUMMARY

Embodiments in accordance with the present invention can provide an antenna assembly that comprises a stepped shaped in a ground plane that can utilize existing architectures such as functional knobs on radios to efficiently provide flexible and varied antenna performance with reduced overall volume.

In a first embodiment of the present invention, an antenna assembly in a radio can include a ground plane formed on a chassis of the radio where the ground plane has a stepped shape forming an antenna element, a notch element in the ground plane substantially adjacent to the stepped shape or in the stepped shape and having length less than ¼ wavelength, and a coaxial cable feeding the antenna element. A shield of the coaxial cable can be directly connected to the ground plane and a center conductor of the coaxial cable can be directly coupled to the stepped shape to provide a galvanic connection for narrowband performance or alternatively the center conductor can be electromagnetically coupled to the stepped shape for wideband performance. The antenna assembly can create a zero volume notch type ground excitation. The placement and direction of the notch element determines a polarization and a radiation pattern of the antenna element. The antenna assembly can be formed for integrated multiple MIMO antennas within the radio with different polarization and radiation patterns. The notch element can be a very short notch element near the stepped shape that forms part of the ground plane. Note that the notch element can be excited in parallel to provide both a galvanic connection for narrowband performance and electromagnetically coupled to the stepped shape for wideband performance for at least two different frequencies. Further note that the stepped shape forms a portion of a functional knob for the radio and can overlap at least a portion of the chassis. In one variant, a galvanic connection can exist between the functional knob and the ground plane formed on the chassis of the radio where a shorting element forms the galvanic connection between the functional knob and the chassis for example. The functional knob can be a rotary switch for squelch or a knob for channel selection or a knob for volume selection. The antenna can have a coupling feed system without a mechanical connection between a body of the functional knob and the coaxial cable, where the functional knob is formed from the stepped shape forming the antenna.

In a second embodiment of the present invention, an antenna assembly in a radio can include a ground plane formed on a chassis of the radio, a functional knob for the radio further having at least a portion of the functional knob serving as the antenna element, a notch element in the ground plane of a predetermined dimension between the antenna element and the chassis, and a coaxial cable (the feed) feeding the antenna element and a shorting element. The antenna assembly can further include a galvanic connection between the functional knob and the central conductor of the feed for narrowband performance or an electromagnetic coupling between the functional knob and the central conductor of the feed for wideband performance or both. A galvanic connection can exist between the functional knob and the ground plane formed on the chassis of the radio. Further note that the functional knob can overlap at least a portion of the ground plane formed on the chassis of the radio. A shorting element can form the galvanic connection between the functional knob and the chassis. The function knob can be a rotary switch for squelch, for channel selection or for volume. The antenna assembly can have a coupling feed system without a mechanical connection between a body of the functional knob and the coaxial cable. Note that the chassis and the stepped shape forming a portion of the functional knob can be on a single plane.

In a third embodiment, an antenna assembly in a radio can include a ground plane formed on a chassis of the radio where the ground plane has a stepped shape forming an antenna element, a functional knob for a radio further having at least a portion of the functional knob serving as the antenna element, a notch element in the ground plane of a predetermined dimension between the antenna element and the chassis, a coaxial cable feeding the antenna element (the feed), and a galvanic connection between the functional knob and the feed for narrowband performance and an electromagnetic coupling between the stepped shape and the feed for wideband performance.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "suppressing" can be defined as reducing or removing, either partially or completely.

The terms "notch," "slot," and the like as used herein, can include a missing portion in a ground plane or a chassis of a radio containing a ground plane. A stepped element or portion as contemplated herein can serve as an antenna or radiating element that can be on the same plane as the ground plane on a chassis or can be slightly offset from the ground plane. The stepped element can form a portion of a functional knob of a radio such as a rotary knob for squelch, channel selection or volume, but is not necessarily limited to such functional knobs. The stepped element can also form a portion of a conventional antenna that can be connected to the chassis of a radio using an SMA connector for example. As contemplated, the stepped element can form any portion of existing radio architectures to provide additional function and performance as further described below.

Other embodiments, when configured in accordance with the inventive arrangements disclosed herein, can include a system for performing and a machine readable storage for causing a machine to perform the various processes and methods disclosed herein.

BRIEF DESCRIPTION OF THE DRAWINGS

FIGS. 4 and 5 illustrate a radio with a cutout in the chassis, FIG. 6 illustrates an SMA ground connector and FIG. 7 illustrates an SMA ground connector and antenna ground all in accordance with embodiments of the present invention.

DETAILED DESCRIPTION OF THE DRAWINGS

Figure 1:
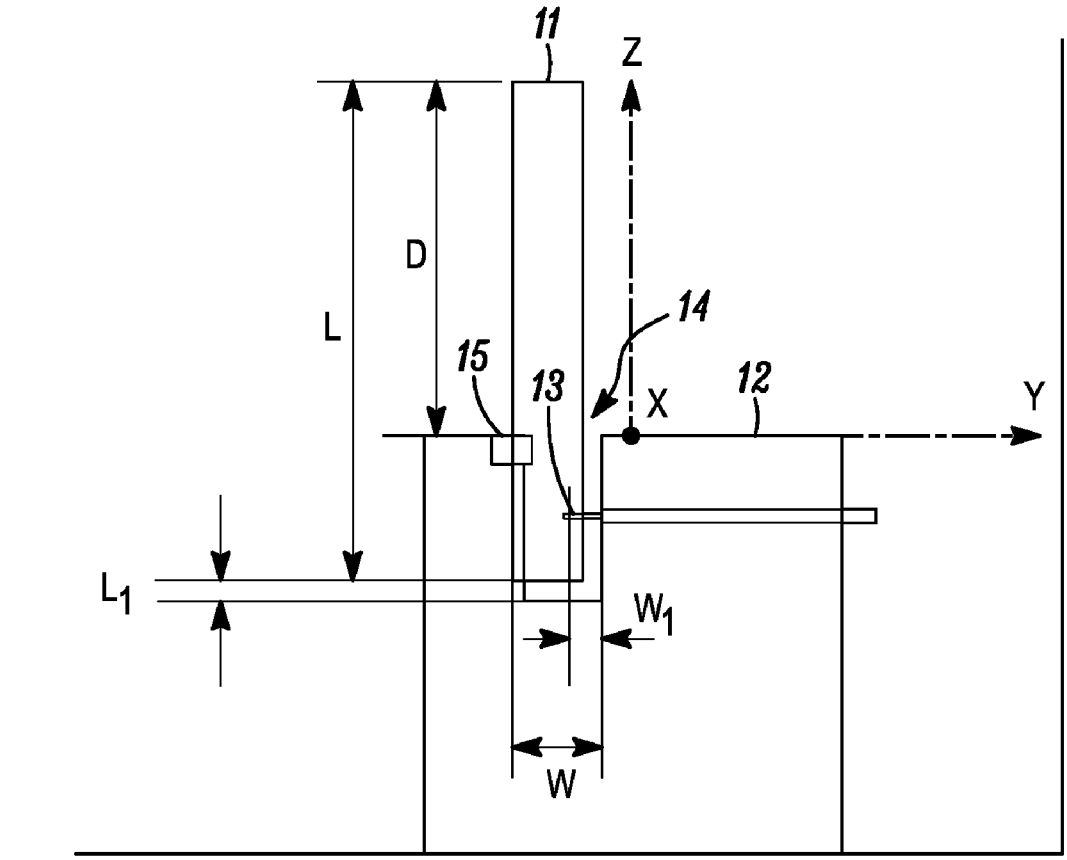
FIG. 1 is an illustration of an antenna assembly including a ground plane having a notch and a functional knob forming an antenna element in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

The antenna and antenna assembly described herein can be very small in comparison to other internal antennas and can be ten percent (10%) the size in volume. Furthermore, the antenna assemblies herein can also utilize or incorporate existing architectures or structures that are already found in radios to reduce the overall size and volume of such radios and thereby enables the antenna to outperform all other internal antennas. These antennas can enhance or complement the antenna type range and can be useful for police radios with function knobs such as channel selector or squelch or volume knobs. The alternative main antenna as the main parasitic element.

Figure 2:
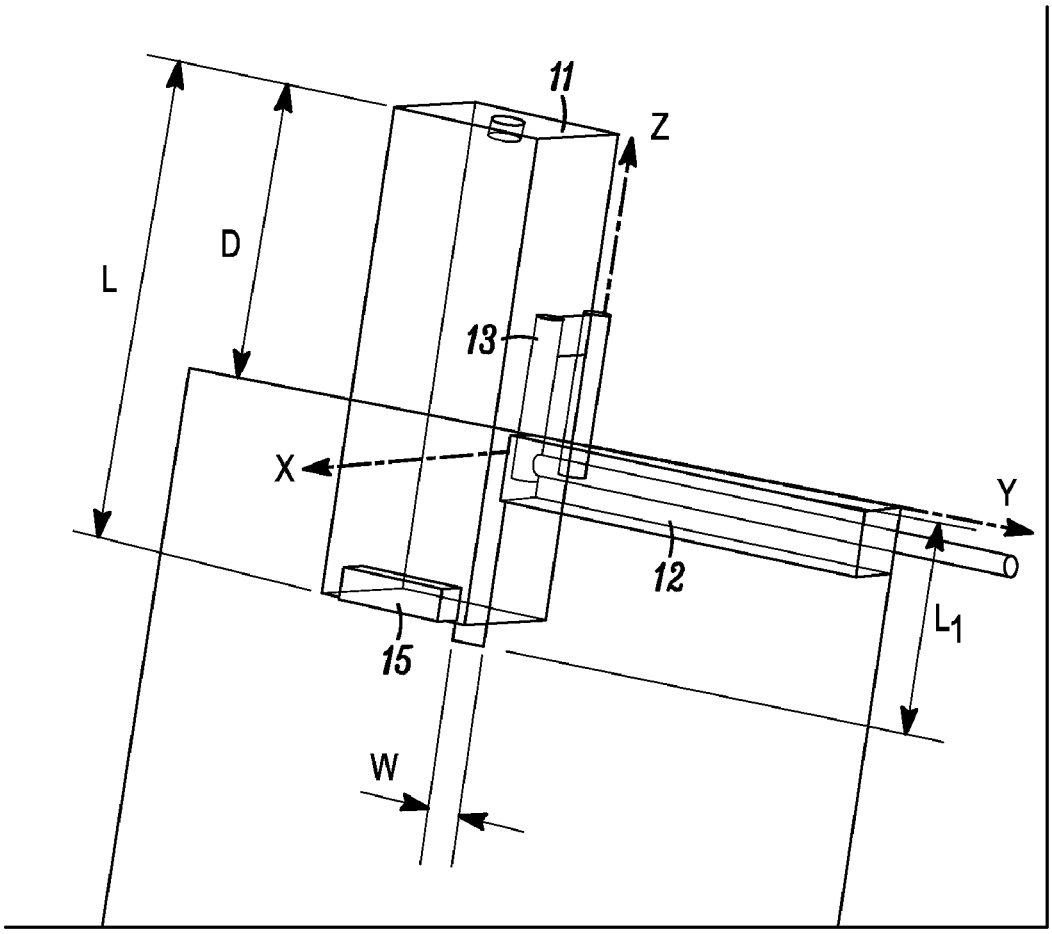
FIG. 2 is a perspective view of the antenna assembly with electromagnetic coupling feed system in accordance with an embodiment of the present invention.
Figure 3:
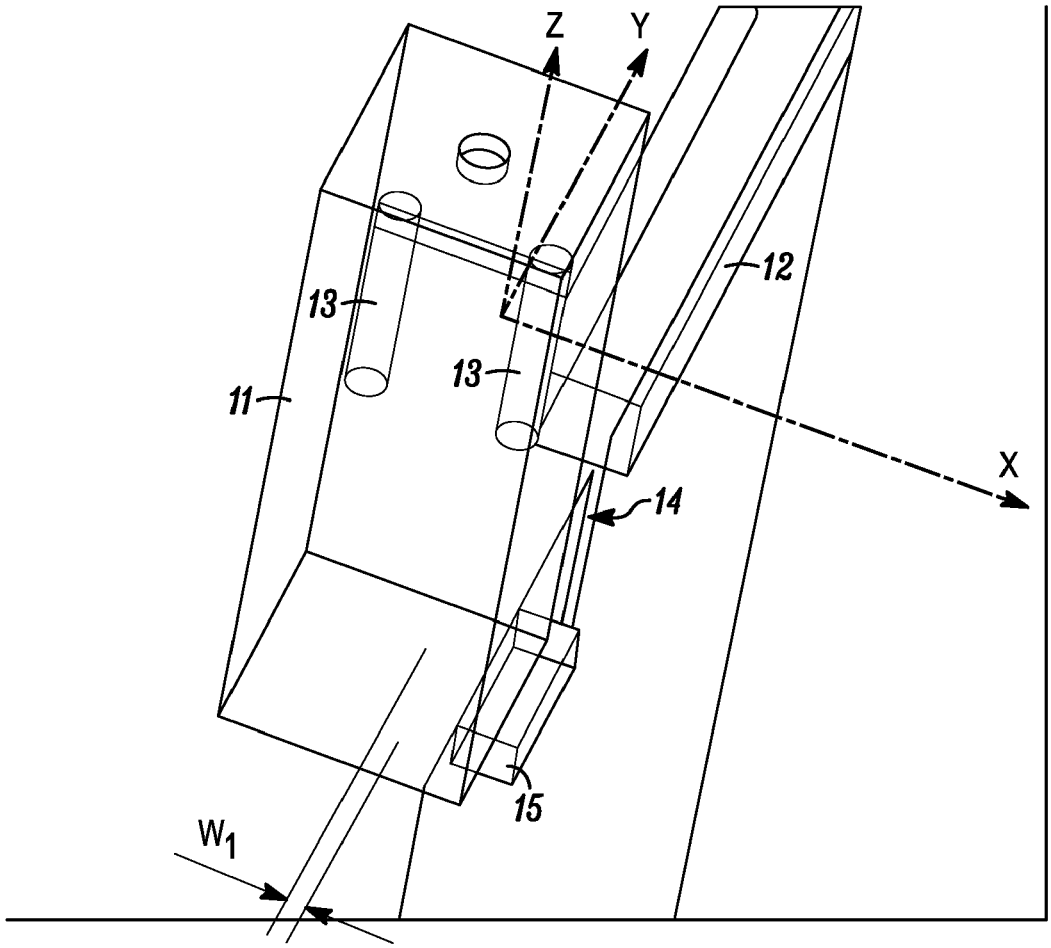
FIG. 3 is another perspective view of the antenna assembly of FIG. 2 in accordance with an embodiment of the present invention.
Figure 10:
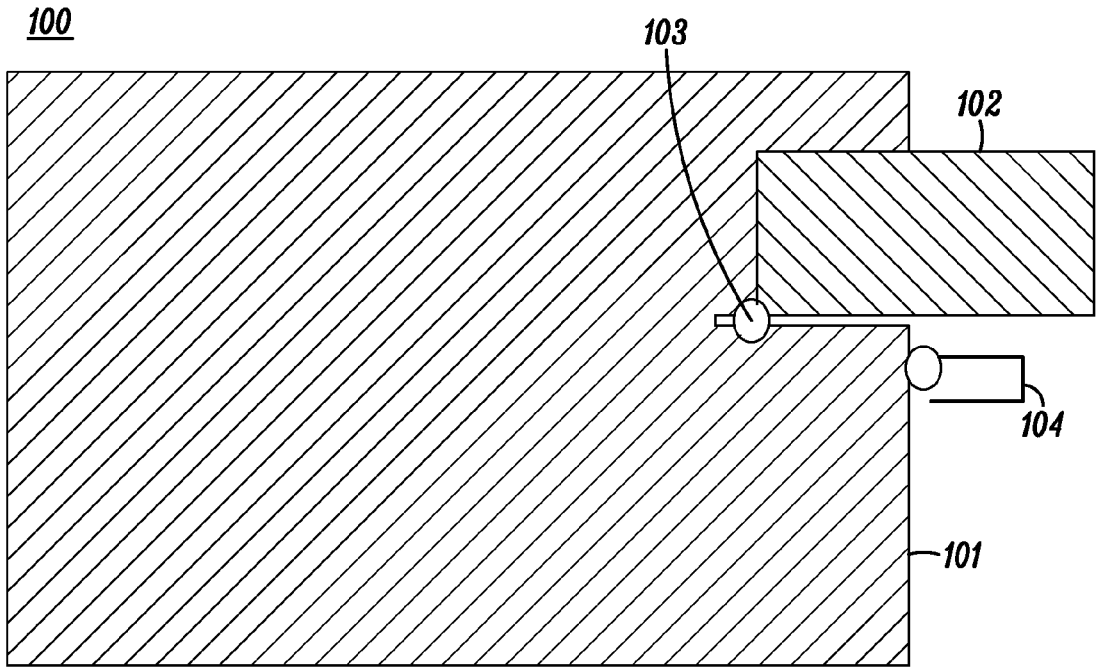
FIG. 10 illustrates an antenna assembly having both or in parallel a galvanic connection to a stepped shape and a electromagnetic coupling to the stepped shape in accordance with an embodiment of the present invention.

Referring to FIGS. 1-3, an antenna assembly 10 is shown in a radio that can include a ground plane formed on a chassis 12 of the radio and the functional knob forming an antenna element 11. The antenna assembly further includes a notch element 14 in the ground plane substantially adjacent to the functional knob 11 and having the length less than ¼ wavelength, and a coaxial cable 13 feeding the antenna element 11. A shield of the coaxial cable can be directly connected to the ground plane and a center conductor of the coaxial cable can be directly coupled to the functional knob to provide a galvanic connection for narrowband performance of the antenna or alternatively the center conductor can be electromagnetically coupled (as shown in FIGS. 2 and 3) to the functional knob for wideband performance of the antenna. The antenna assembly can create a zero volume notch type ground excitation. The placement and direction of the notch element determines a polarization and a radiation pattern of the antenna element. The antenna assembly can be formed for multiple integrated Multiple-input multiple-output (MIMO) antennas within the radio with different polarization and radiation patterns. The notch element 14 can be a very short notch element near the functional knob 11. Note that the notch element 14 can be excited in parallel (as shown in FIG. 10) to provide both a galvanic connection for narrowband performance and electromagnetically coupled to the functional knob for wideband performance for two different frequencies. Further note as seen in FIG. 1, that the functional knob 11 can overlap a portion of the ground plane or chassis 12. In one variant, a galvanic connection can exist between the functional knob 11 and the ground plane formed on the chassis 12 of the radio where a shorting element 15 forms the galvanic connection between the function knob 11 and the chassis 12 for example. The functional knob 11 can be a rotary switch for squelch or a knob for channel selection or a knob for volume selection. The antenna element 11 can have a coupling feed system without a mechanical connection (e.g., no shorting element 15) between a body of the functional knob and the coaxial cable. An antenna as described above can be termed a single plane notch excited antenna that serves as a minimal volume integrated antenna with controlled radiation properties.

Embodiments herein can be generally be used as internal antennas for portable or mobile radio equipment. Existing internal antennas in radio equipment are typically variations of a PIFA antenna with a volume inside of the equipment of approximately $0.10\times0.15\times0.15\lambda$. The embodiments herein can significantly reduce the internal volume used in a radio by planting a small notch in a chosen point, with an (almost) plane structure of $0.15\times0.05\times0.02\lambda$ which is significantly less than the noted existing PIFA antenna.

Figure 4:
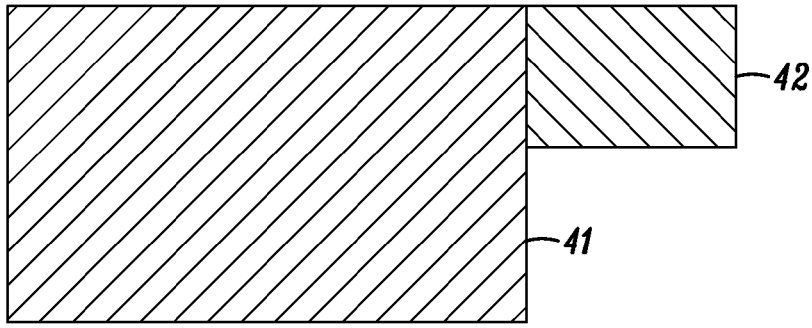
FIGS. 4-7 illustrate various antenna assembly architectures with various stepped shapes where
Figure 5:
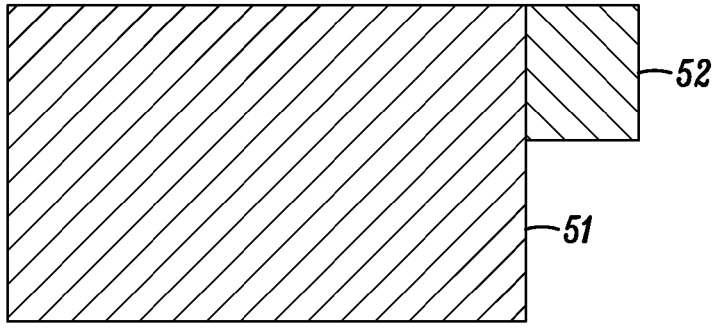
Figure 6:
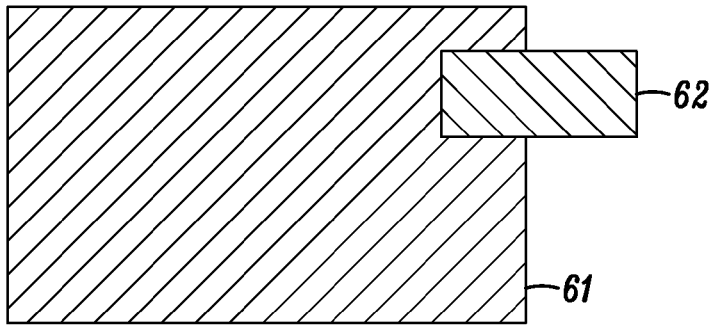
Figure 7:
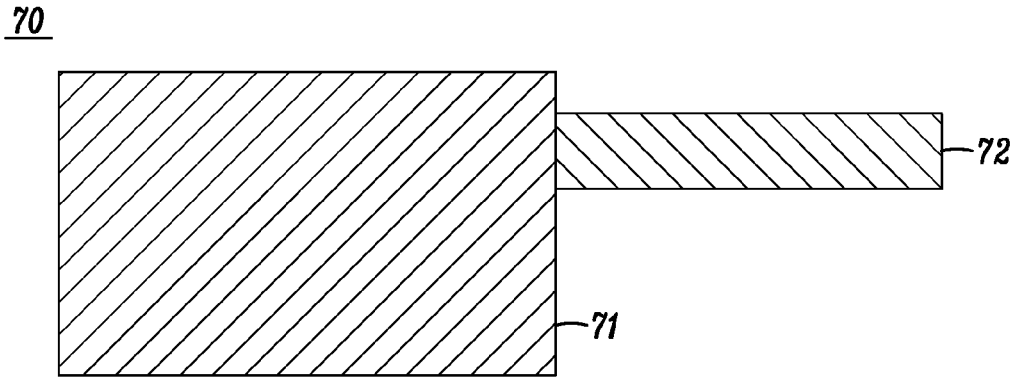

This structure in accordance with the embodiments herein can be particularly applicable for cellular, GPS and 2.4 GHz antennas where today's handheld equipment is looking to decrease the it's volume. In modern cellular phones or handheld terminals, the location and type of the antenna used are important. Note that the embodiments herein can be used in a variety of configurations without deviating from the broad scope contemplated. For example, with reference to FIGS. 4-9, the antenna assemblies 40, 50, 60, 70, 80 and 90 respectively can take on various forms and still be within the claimed embodiments herein. In general, almost any ground plane including a stepped shape element can be exited for purposes of an antenna assembly in accordance with the embodiments. For example, FIGS. 4 and 5 illustrate a radio having a ground plane in the chassis with cutouts of various sizes that form a stepped element. In the case of FIG. 4, the assembly 40 includes a chassis 41 and a stepped element 42 serving as the antenna element. In FIG. 5, the assembly 50 includes a chassis 51 and a stepped element 52 serving as the antenna element. The stepped element 42 and 52 from the FIGS. 5 and 6 respectively, can be a portion of the ground planes of the chassis 41 and 51 respectively. The antenna assembly 60 of FIG. 6 can include a chassis 61 and stepped element 62. The stepped element 62 can be a body of the SMA connector or a functional knob. The stepped element 62 has overlap with portion of the ground plane of the chassis 61. The connection between the stepped element 62 and ground plane on the chassis 61 can be a body of an SMA connector coupled to ground. Similarly, the antenna assembly 70 of FIG. 7 can include a chassis 71 and stepped element 72 where the connection between the stepped element 72 and ground plane on the chassis 71 can be a body of the SMA connector coupled to ground where the SMA connector is part of an external antenna that is also grounded.

Figure 8:
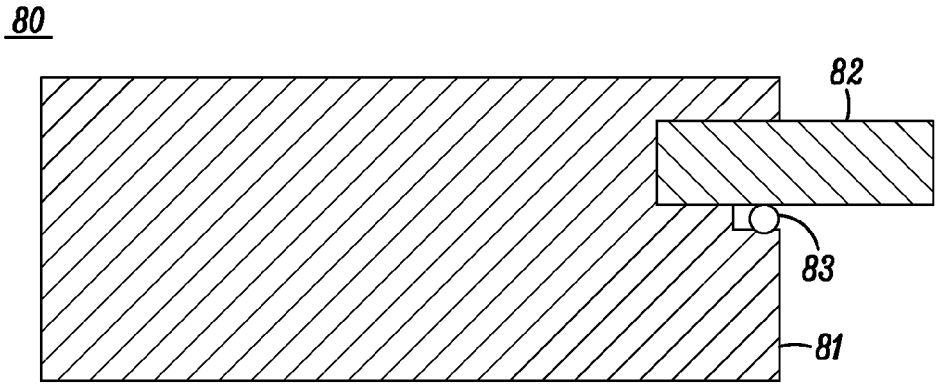
FIG. 8 illustrates an antenna assembly with a coaxial cable having a galvanic connection to a stepped shape forming the antenna in accordance with an embodiment of the present invention.
Figure 9:
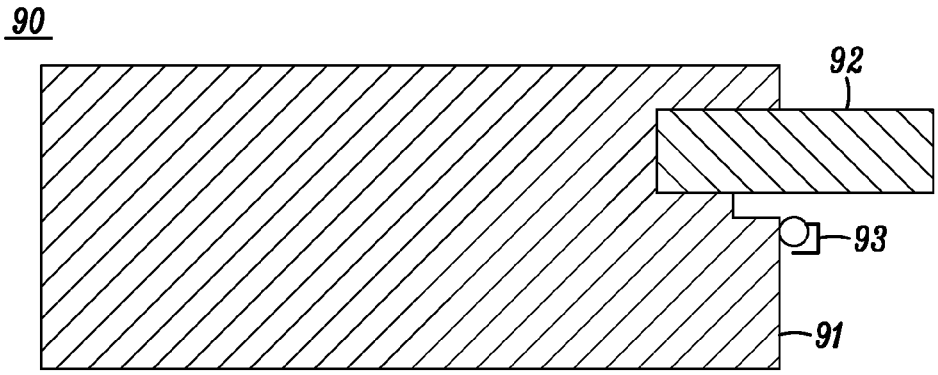
FIG. 9 illustrates an antenna assembly with a coaxial cable having a electromagnetic coupling to the stepped shape forming the antenna in accordance with an embodiment of the present invention.

With respect to FIGS. 8 and 9, it should be noted that modifications to a feed (such as a coaxial feed) can provide additional flexibility and performance beyond the size benefits already discussed above. With modifications to the feed, very wide bandwidth for the main frequency can be achieved by using the electromagnetic coupling feed system instead of the direct (galvanic) feed system. Furthermore, the modified feed can also provide control over additional polarizations which can be useful for GPS applications. Referring to FIG. 8, an antenna assembly 80 can include a chassis 81 and stepped element 82 where the connection between a feed 83 and the stepped element 83 can be a galvanic connection. Referring to FIG. 9, an antenna assembly 90 can include a chassis 91 and stepped element 92 (serving as an antenna element) where the connection between a feed 93 and the stepped element 93 can be a electromagnetic connection.

With respect to FIG. 10, an antenna assembly 100 of a radio can include a chassis 101 and a stepped element 102 serving as an antenna element that can be a portion of a function knob. The antenna assembly 100 can further include a galvanic connection between the stepped element 102 and a feed 103 for narrowband performance and an electromagnetic coupling between the stepped element 102 and a feed 104 for wideband performance. These two feeds can be exciting the one body of the antenna into two different frequencies.

As noted above, embodiments herein do not require a special volume inside or outside a radio unit, but instead can facilitate the use of an existing unit's architecture to accommodate additional elements without global changes in the mechanical parts and into the outside shape of a device. The antenna utilizes the difference between heights of the existing elements of the unit and overlapping of the elements. As such, embodiments herein can include the use of a body or portion of a rotary switch that has an overlap with the chassis (or main board) of a radio. The chassis (or main board) has a role of the ground plane with a notch. The bodies, namely the chassis having the ground plane and the stepped element or antenna can be located on the same value of the axis x or essentially on the same plane, although embodiments can also include slight offsets. In a typical embodiment, an inner conductor of a coaxial cable can be connected to the body rotary switch or stepped element where the outer conductor of the coaxial cable is connected to the chassis.

Referring once again to the antenna assembly of FIG. 1, the chassis 12 can be overlapped by the functional knob 11 that illustrates an offset $W_1$ from the chassis along a Y axis. The antenna has a coupling feed system that does not necessarily require a mechanical connection between the body of existing functional knob (or body of other antenna) and a central conductor of the coaxial cable 13. The outer conductor of the coax cable 13 though can have a galvanic connection to chassis 12. Radiation patterns taken for various embodiments herein demonstrated applicability for both cellular and GPS applications in frequencies around 1.9 GHz (for cellular) and around 2.4 GHz (for WLAN applications).

In light of the foregoing description, it should be recognized that embodiments in accordance with the present invention can be realized in hardware, software, or a combination of hardware and software if software is use to control or detect physical connections or distances between certain claimed elements that can provide variation in antenna characteristics or performance. It should also be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. An antenna assembly in a radio, comprising:

a ground plane formed on a chassis of the radio, wherein the ground plane has a stepped shape forming an antenna element;

a functional knob for the radio further having at least a portion of the functional knob serving as the antenna element;

a notch element in the ground plane substantially adjacent to the stepped shape or in the stepped shape and having length less than ¼ wavelength; and a coaxial cable feeding the antenna element, wherein a shield of the coaxial cable is directly connected to the ground plane and wherein a center conductor of the coaxial cable is directly coupled to the stepped shape to provide a galvanic connection for narrowband performance or electromagnetically coupled to the stepped shape for wideband performance.

2. The antenna assembly of claim 1, wherein the antenna assembly creates a zero volume notch type ground excitation.

3. The antenna assembly of claim 1, wherein the placement and direction of the notch element determines a polarization and a radiation pattern of the antenna element.

4. The antenna assembly of claim 1, wherein the notch element comprises a very short notch element near the stepped shape that forms part of the ground plane.

5. The antenna assembly of claim 1, wherein the notch element can be excited in parallel to provide a galvanic connection for narrowband performance and electromagnetically coupled to the stepped shape for wideband performance in at least two different frequencies.

6. An antenna assembly in a radio, comprising:

a ground plane formed on a chassis of the radio, a functional knob for the radio further having at least a portion of the functional knob serving as an antenna element;

a notch element in the ground plane of a predetermined dimension between the antenna element and the chassis; and a coaxial cable feeding the antenna element, wherein a shield of the coaxial cable is directly connected to the ground plane and wherein a center conductor of the coaxial cable is directly coupled to the functional knob to provide a galvanic connection for narrowband performance or electromagnetically coupled to the functional knob for wideband performance.

7. The antenna assembly of claim 6, wherein the antenna assembly creates a zero volume notch type ground excitation.

8. The antenna assembly of claim 6, wherein the placement and direction of the notch element determines a polarization and a radiation pattern of the antenna element.

9. The antenna assembly of claim 6, wherein the notch element comprises a very short notch element near a stepped shape that forms part of the ground plane.

10. The antenna assembly of claim 6, wherein the antenna assembly further comprises a galvanic connection between the functional knob and a central conductor of the coaxial feed for the radio.

11. The antenna assembly of claim 6, wherein the antenna assembly further comprises an electromagnetic coupling between the functional knob and a central conductor of the coaxial feed for the radio.

12. The antenna assembly of claim 6, wherein the antenna assembly further comprises a galvanic connection between the functional knob and a feed of the radio for narrowband performance and an electromagnetic coupling between the stepped shape and the feed of the radio for wideband performance in at least two different frequencies.

13. The antenna assembly of claim 12, wherein the ground plane on the chassis and the stepped shape forming a portion of the functional knob are on a single plane.

14. The antenna assembly of claim 6, wherein a portion of the functional knob for the radio has overlap with the ground plane formed on the chassis of the radio.

15. The antenna assembly of claim 6, wherein a galvanic connection exists between the functional knob and the ground plane formed on the chassis of the radio.

16. The antenna assembly of claim 6, wherein a shorting element forms a galvanic connection between the functional knob and the ground plane formed on the chassis.

17. The antenna assembly of claim 6, wherein the functional knob is selected among a rotary switch for squelch, channel, and volume selection.

18. The antenna assembly of claim 6, wherein the antenna assembly has a coupling feed system without a mechanical connection between a body of the functional knob and the coaxial cable.

19. An antenna assembly in a radio, comprising:

a ground plane formed on a chassis of the radio, wherein the ground plane has a stepped shape forming an antenna element;

a functional knob for the radio further having at least a portion of the functional knob serving as the antenna element;

a notch element in the ground plane of a predetermined dimension between the antenna element and the chassis;

a coaxial cable feeding the antenna element; and a galvanic connection between the functional knob and a feed from the coaxial cable of the radio for narrowband performance and an electromagnetic coupling between the stepped shape and the feed for wideband performance.

* * * * *